United States Patent [19]

Marchak

[11] 4,266,275

[45] May 5, 1981

[54] ACCELERATION ENRICHMENT FEATURE FOR ELECTRONIC FUEL INJECTION SYSTEM

[75] Inventor: Roman O. Marchak, Northville, Mich.

[73] Assignee: The Bendix Corporation, Southfield, Mich.

[21] Appl. No.: 24,628

[22] Filed: Mar. 28, 1979

[51] Int. Cl.[3] ..... F02B 3/00; F02M 7/06

[52] U.S. Cl. ..... 364/431; 123/179 L; 123/492

[58] Field of Search ..... 364/431, 442; 123/32 EA, 32 EG, 32 EH, 179 L, 180 E

[56] References Cited

U.S. PATENT DOCUMENTS

| | | | |
|---|---|---|---|
| 3,593,692 | 7/1971 | Scholl et al. | 123/32 EA |
| 3,759,231 | 9/1973 | Endo | 123/32 EA |
| 3,763,833 | 10/1973 | Rachel | 123/32 EA |
| 3,771,502 | 11/1973 | Reddy | 123/179 L |
| 3,778,729 | 12/1973 | Ciemochowski | 123/180 E |
| 3,971,354 | 7/1976 | Luchaco et al. | 123/179 L |
| 3,987,764 | 10/1976 | Scofield | 123/32 EA |
| 4,010,717 | 3/1977 | Taplin | 123/32 EH |
| 4,015,563 | 4/1977 | Drews et al. | 123/32 EH |
| 4,114,570 | 9/1978 | Marchak et al. | 123/32 EG |
| 4,143,621 | 3/1979 | Long | 123/32 EG |
| 4,148,283 | 4/1979 | Harada et al. | 123/32 EH |
| 4,159,697 | 7/1979 | Sweet | 123/32 EH |
| 4,176,625 | 12/1979 | Stauffer | 123/32 EH |

*Primary Examiner*—Felix D. Gruber

*Attorney, Agent, or Firm*—William A. Marvin; Russel C. Wells

[57] ABSTRACT

An acceleration enrichment feature for an electronic fuel injection system is disclosed. The enrichment feature includes an operating parameter enrichment circuit which provides an acceleration signal proportional to the rate of change of an engine operating parameter that is indicative of a desired acceleration. The acceleration signal is combined with an off-closed throttle enrichment signal and the combination is transmitted to a peak detect and decay circuit which produces a control voltage signal equivalent to the peak of the two signals. The control voltage signal from the peak detect and decay circuit is used to regulate a voltage controlled current sink generating an acceleration enrichment signal which varies the termination threshold of the main pulse generation. Additionally included is a warm-up multiplier circuit which varies the acceleration enrichment signal as a function of the engine coolant temperature.

13 Claims, 16 Drawing Figures

Fig-1
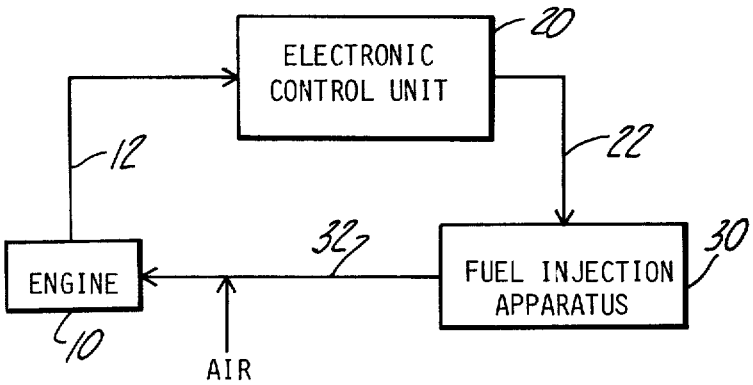
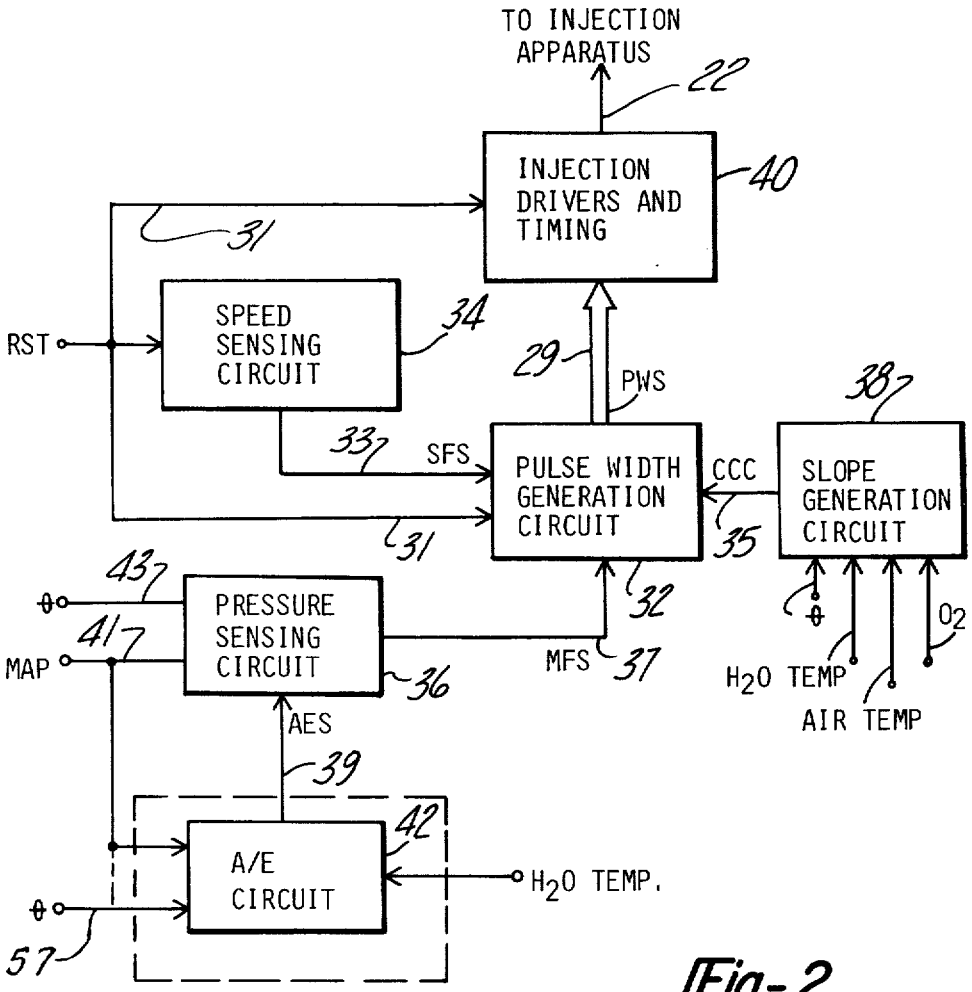
Fig-2

RST $V_{C2}$
V CLAMP
106
ΔAES
100
104
MFS
SFS
CCC

102
PWS $PW_1$
PW (AE)
PARTIAL THROTTLE
$P_3$
$P_2$
MFS
$P_1$
WOT
$P_4$ $B_1$
$B_2$
MAP

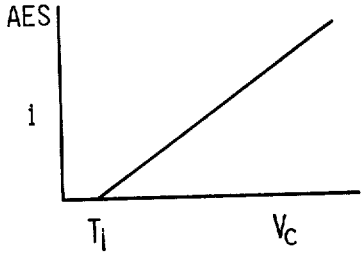
Fig-9A
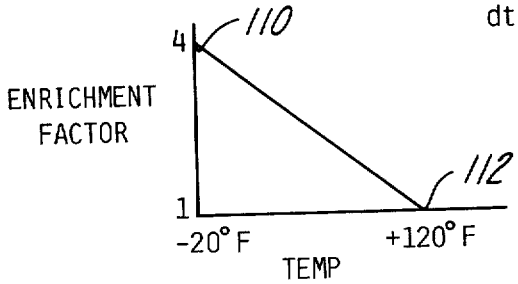
Fig-9B
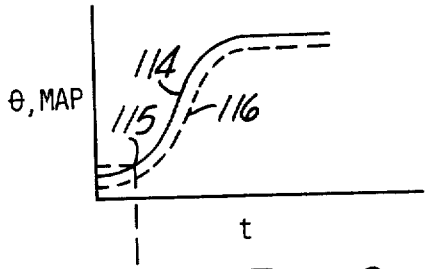
Fig-9C
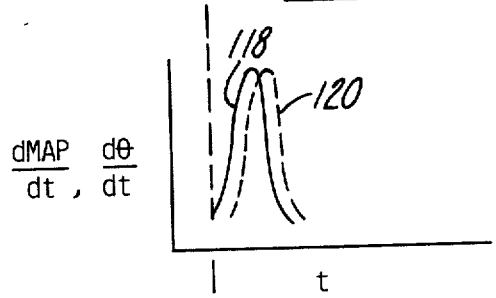
Fig-9D
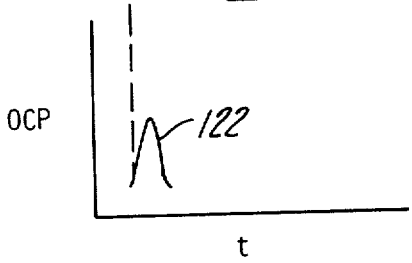
Fig-9E
Fig-9F
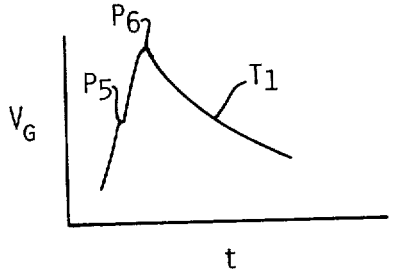

ACCELERATION ENRICHMENT FEATURE FOR ELECTRONIC FUEL INJECTION SYSTEM

BACKGROUND OF THE INVENTION

The invention pertains generally to electronic fuel management control systems and is more particularly directed to an acceleration enrichment feature for such systems having a pulse width generation circuit which utilizes a threshold voltage for terminating the pulses.

Electronic fuel management systems have been developed where the quantity of fuel to be ingested into the intake manifold of an internal combustion engine is calculated from the measurement of various engine operating parameters. These parameters generally describe the mass air flow into the engine and primarily include the speed of the engine, the manifold absolute pressure, and the air temperature. Other secondary parameters, such as special calibrations for warm-up conditions or for closed loop operation, further comprise the engine coolant temperature and the composition of the exhaust gases in the exhaust manifold of the engine.

All of the measured parameters are input to an electronic control unit which schedules the fuel quantity accordingly and produces a pulse width signal. The pulse width signal, the duration of which is determined by the calculated fuel quantity, is generated by a pulse generation circuit in the electronic control unit at a cyclic rate dependent upon the speed of the engine. An injection apparatus responsive to the pulse duration is then utilized to input the desired quantity of fuel into the engine.

An example of an advantageous fuel management system of this type is described in U.S. Ser. No. 918,306 filed on June 22, 1978 in the names of R. W. Carp, et al. and commonly assigned with the present application, the disclosure of which is hereby expressly incorporated by reference herein.

The main pulse width generation circuit described by Carp, et al. initiates a leading edge for each pulse of the variable duration signal at a rate dependent on the engine speed. The pulse continues until a variable slope ramp voltage, started at the leading edge of the pulse and at an initiating voltage dependent upon another engine parameter, intercepts a termination voltage at which time a trailing edge of the pulse is generated. The termination voltage is provided as a function of the absolute pressure of the intake manifold of the engine.

By generating the pulse duration in such a manner, the final variable modifying the pulse width is additionally the most important to the calculation since it will be the last time until the next pulse generation that information can be added to the calculation. Since it is the basic calibration factor for the calculation of mass air flow in a speed density system, the termination potential in the described system is the manifold absolute pressure (MAP).

The termination voltage may further be used as a means of adding additional enrichment to the operational schedule of the engine in response to the increased needs of the engine during accelerations or transient conditions. Increasing the termination voltage by an incremental value based on a desired acceleration will cause the ramp voltage to intercept the level later in time and consequently extend the pulse duration. Acceleration commands that are received prior to the termination of the pulse width will not be lost and will provide a richer air/fuel ratio at a faster response with this method.

The Carp, et al. circuit, however, does not use such an acceleration enrichment scheme and is provided with a separate pulse generator for additional fuel increases during transient conditions. The separate pulse generator is connected in parallel with the main pulse generator and a special pulse addition circuit utilized to combine the two asynchronous pulse waveforms.

U.S. Pat. No. 4,010,717 issued to Taplin discloses using an acceleration enrichment signal voltage added directly to a manifold absolute pressure signal to yield a termination voltage for a pulse generator. The termination voltage, however, in Carp, et al. is not merely a MAP voltage, but a calibrated function of the manifold absolute pressure. A simple analog addition of the signals will thus cause the circuits to interact and be dependent upon one another. Also trimming the acceleration signal for a threshold value would change the complex MAP function deleteriously if a simple analog combination were proposed.

It is, therefore, an object of the invention to provide a pulse width generation circuit with an acceleration enrichment signal that varies the termination voltage of the pulse width without affecting the accuracy of the calibrated MAP function voltage.

A desirable feature found in the separate pulse generator enrichment circuit of Carp, et al. is the provision for the duration of the additional AE pulses to be dependent upon the engine coolant temperature. When an internal combustion engine is cold, greater amounts of enrichment are needed for the same acceleration. Providing a temperature dependent enrichment smooths out the operation of the engine after cold starting until the standard operational temperature of the engine is reached.

It is, therefore, an object of the invention to provide an acceleration enrichment signal dependent upon engine coolant temperature which can be generated as an incremental increase to the pulse termination voltage.

Another desirable feature found in the enrichment circuit of Carp, et al. is the provision for an independent off-closed throttle pulse to be generated. If the internal combustion engine is idling or operating at nearly closed throttle, an acceleration command will necessitate more enrichment than if the speed and throttle angle displacement is greater. This is commonly referred to as a "tip-in" condition. During these conditions, as from a standing start or when starting to pass from a low speed, the operator expects a generally more responsive acceleration than at higher speeds and loads for similar acceleration commands. Ideally, the acceleration schedule should be an inverse function of speed which is more complex than the linear function as is taught in the Taplin reference. It has been found that the off-closed throttle pulse is a very facile and efficient way of approximating more ideal acceleration functions without undue increases in circuitry.

It is, therefore, still another object of the invention to provide a further incremental enrichment during "tip-in" conditions by modifying the termination voltage of the main pulse width.

SUMMARY OF THE INVENTION

In accordance with the objects of the invention, there is provided an acceleration enrichment circuit that generates an acceleration enrichment signal which changes the termination threshold of a main pulse generator to enrich the air/fuel ratio during operator induced transients.

The acceleration signal is preferably in the form of a controlled current drawn from the pressure sensing circuit of the main pulse generator by a voltage controlled current sink. The current sink can be trimmed for an acceleration enrichment calibration without interacting and affecting the manifold absolute pressure calibration.

The acceleration enrichment circuit further includes a peak detect and decay circuit which produces a control voltage for regulating the current drawn through the sink. The control voltage is detected as the peak amplitude of the rate of change of an operating parameter indicative of a desired acceleration. Preferably, the operating parameter detected is the differentiated value of the throttle blade position, or, alternatively, the manifold absolute pressure. The first derivative of these parameters is generally an excellent measure of the acceleration desired.

The control voltage is further detected as the peak voltage of a pulse generated as the throttle blade opens from a closed position. The peak of this pulse will cause the current sink to produce sufficient "tip-in" enrichment for the engine to prevent hesitations when accelerating from idle or closed throttle positions.

The peak detect and decay circuit further holds the control voltage and causes a smooth exponential decay thereof. The rate of the exponential decay is equivalently controlled by the overall amount of enrichment desired for a predetermined peak of the off-closed throttle pulse and the operating parameter signal.

Further included in the acceleration enrichment circuit is a warm-up multiplier circuit operable to vary the acceleration enrichment signal as a function of the engine coolant temperature. The warm-up multiplier circuit performs a linear multiplication of the acceleration enrichment current times a warm-up factor developed from the coolant temperature. In the preferred embodiment, the multiplier is implemented as a variable duty cycle switch connected in series with the current sink. The duty cycle of the on-time to the off-time of the switch can be varied in accordance with the warm-up factor to linearly multiply the acceleration enrichment current thereby. The warm-up factor in the implementation illustrated is a linearly decreasing function with increases in engine coolant temperature.

These and other features, advantages and aspects of the invention will be more fully understood and better explained if a reading of the detailed description is undertaken in conjunction with the appended drawings wherein:

BRIEF DESCRIPTION OF THE DRAWINGS

FIG. 1 is a schematic block diagram of an electronic fuel management system;

FIG. 2 is a detailed schematic block diagram of the electronic control unit illustrated in FIG. 1 including an acceleration enrichment circuit constructed in accordance with the invention;

FIGS. 7A to 7C, 8, 9A to 9F are representative pictorial views of waveforms at the various places in the circuitry as detailed in the description.

DETAILED DESCRIPTION OF THE PREFERRED EMBODIMENT

Figure 3:
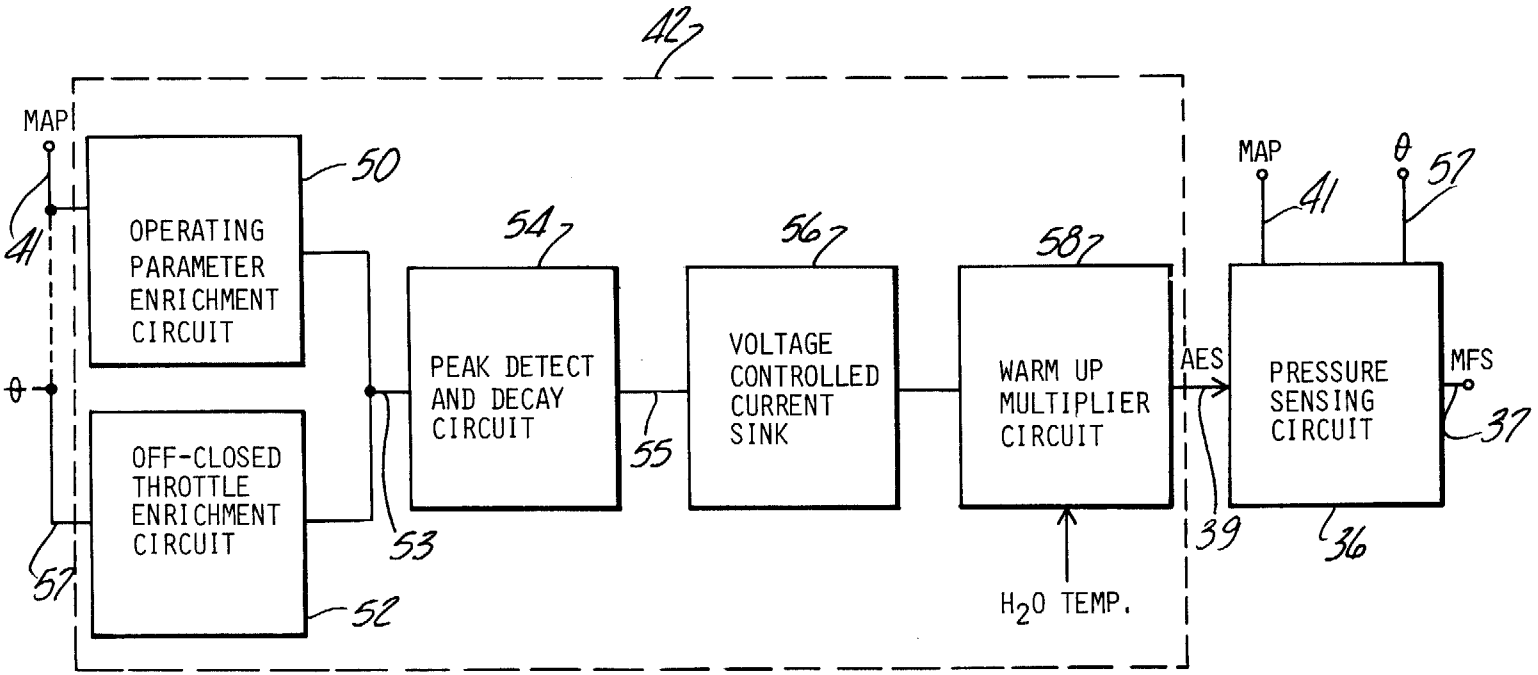
FIG. 3 is a detailed schematic block diagram of the acceleration enrichment circuit illustrated in FIG. 2.

With reference now to FIG. 1, there is shown an electronic fuel management system comprising generally a fuel injection apparatus 30 which provides fuel to the air ingestion path 32 of an internal combustion engine 10. The fuel injection apparatus 30 can comprise either single or multiple groups of fuel injectors in either multipoint or single-point systems or an electronic carburetor. Preferably, the hereinafter disclosed acceleration enrichment feature is most advantageously used in single-point systems, but should not be limited to such.

The amount of fuel provided by the fuel injection apparatus 30 is determined by a pulse width signal generated from an electronic control unit 20 via a line 22. The duration of the pulse is an indication of the quantity of fuel that the electronic control unit 20 has calculated from the operating parameters of the engine, which are received from the engine via a transducer bus 12.

It is known that conventional parameters input to the electronic control unit are related generally to mass air flow and are the speed or RPM at which the engine is turning, the manifold absolute pressure (MAP), and the air temperature (AIR TEMP). Further parameters that may be input to determine the duration of the pulses are the coolant temperature of the engine ($H_2O$ TEMP), and the composition of the exhaust gases ($O_2$). Additionally, other indicators can be used, such as the angular position ($\theta$) of the throttle blade for the air ingestion path 32. A fuel management system including all of the above features is more fully illustrated in the above-incorporated Carp, et al. reference.

A detailed block diagram of the electronic control unit 20 of the fuel management system just described is illustrated in FIG. 2 wherein a main pulse width generation circuit 32 develops the pulse width signal (PWS) and transmits it to a driver and timing circuit 40, which transmits the pulse width signal at the correct voltage and current levels to energize the injection apparatus 30. The driver and timing circuit 40 is further used to gate the pulse width signal to the correct injector group if more than one is occasioned by the system configuration.

The pulse width generation circuit as taught by Carp. et al. in U.S. Ser. No. 918,306, now U.S. Pat. No. 4,212,066 entitled "Hybrid Electronic Control Unit" and which is hereby expressly incorporated by reference herein calculate the length of the pulse width signal, or PWS signal, from four separate input signals. The first is a timing signal indicating an angular event of the engine related to the speed, or an RST signal, which is input via line 31. This timing signal is used to initiate the start of the pulse width at a voltage level input through line 33 from a speed sensing circuit 34. The speed sensing circuit 34 receives the RST signal, which is representative of the speed of the engine, and develops the voltage level, SFS, as a function of the speed of the engine.

From this level a variable slope is generated by a current signal, CCC, from a slope generation circuit 38 which, when it intercepts another level provided by an MFS signal via line 37, completes the pulse width generation. The slope generation circuit provides a current signal, CCC, as a function of the throttle angle $\theta$, the water temperature signal ($H_2O$ TEMP), the air temperature signal (AIR TEMP), and an additional signal, $O_2$, from an oxygen sensor located in the exhaust manifold of the engine 10.

The MFS signal is generated by a pressure sensing circuit 36, which has input to it the manifold absolute pressure signal (MAP), and also the throttle angle signal ($\theta$).

Additionally, according to the invention, the pulse terminating threshold signal MFS, is modified by an acceleration enrichment signal AES provided via line 39 from an acceleration enrichment circuit 42. The acceleration enrichment circuit 42 has inputs from the engine coolant temperature signal ($H_2O$ TEMP), and from the manifold absolute pressure signal (MAP), or, alternatively, from the throttle angle signal ($\theta$).

With reference now to FIG. 3, there is shown a detailed block diagram of the acceleration enrichment circuit 42 to which the invention is directed. The acceleration enrichment circuit 42 comprises a voltage controlled current sink 56, which has an input control voltage via line 55 which regulates the AES signal current to change the termination threshold for providing the acceleration enrichment.

The control voltage is developed by a peak detect and decay circuit 54 which detects the peak voltage transmitted from either an engine operating parameter enrichment circuit 50, or an off-closed throttle enrichment circuit 52 via line 53. The peak detect and decay circuit 54 holds that voltage level and thereafter causes a slow decay for controlling the current sink 56.

The engine operating parameter enrichment circuit 50 has, as an input, an operating parameter related to the amount of acceleration desired, usually either the throttle angle signal $\theta$ or the manifold absolute pressure signal, MAP. The rate of change of these operating parameters is generally an indication of the amount of acceleration enrichment desired and is provided via line 53 to the peak detect indicate circuit 54. Additionally, the off-closed throttle enrichment circuit 52 provides a voltage signal pulse just as the throttle moves off of its closed position to provide additional enrichment during a "tip-in" from idle for smooth acceleration and engine performance.

A warm-up multiplier circuit 58 is connected to receive the acceleration enrichment signal AES from the voltage controlled current sink 56 and multiply it by a warm-up factor related to the engine coolant temperature as indicated by the signal $H_2O$ TEMP.

Figure 4:
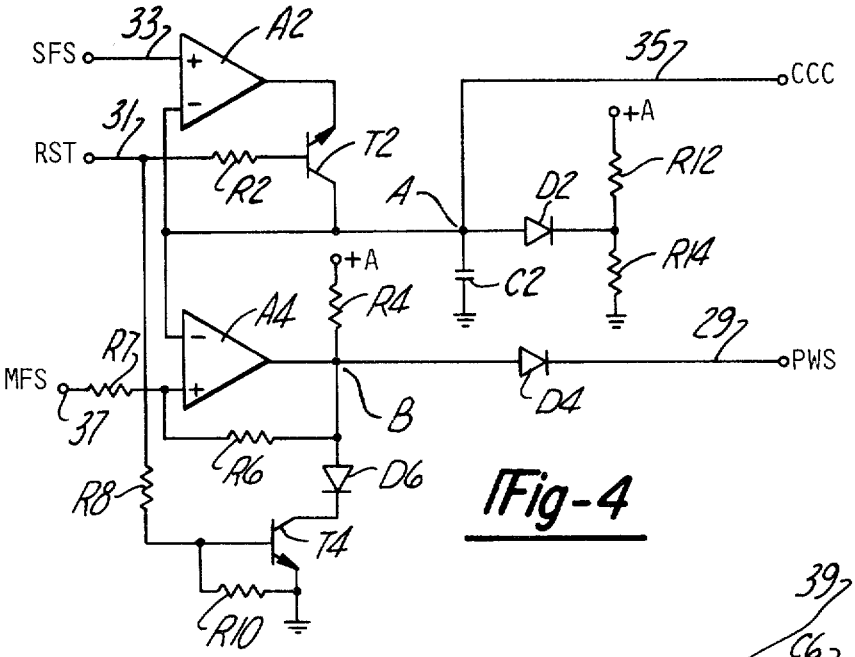
FIG. 4 is a detailed schematic circuit diagram of the pulse generation circuit illustrated in FIG. 2.

With reference now to FIG. 4, the detailed circuitry comprising the pulse width generation circuit 32 is shown. The pulse width generation circuit 32 comprises basically an operational amplifier A4 operating as a comparator having its inverting input, at a voltage node A, connected to one terminal of a timing capacitor C2 whose other terminal is connected to ground. At the non-inverting input of the amplifier A4 via an input resistor R7, is received the manifold function signal MFS from a terminal line 37 which connects to the pressure sensing circuit 36.

The output of the amplifier A4 is connected to a node B which is provided with a current pull-up via a resistor R4 connected between the node and a positive source of voltage, +A. A positive feedback hysteresis resistor R6 is further connected between the node B and the non-inverting input of the amplifier A4. The output of the amplifier A4 is the PWS signal and is generated through a blocking diode D4 to the injection driver and timing circuit over conductor line 29.

The charging current signal CCC is connected via line 35 to the node A to charge the capacitor C2 and provide a variable slope ramp. A discharge path for the capacitor C2 is provided by a transistor T2 connected with its collector to node A and its emitter to the output of an amplifier A2. The operational amplifier A2 has its inverting input connected to node A and its non-inverting input receives via terminal line 33 the speed function signal SFS.

A clamping circuit for the capacitor C2 is provided comprising diode D2 and a pair of resistors R12, R14 by connecting node A to the anode of the diode D2 and thereafter connecting the cathode to the junction of the divider resistors R12 and R14 which are connected between a source of positive voltage, +A, and ground.

Completing the pulse generation circuit is a holding circuit comprising a transistor T4 connected with its collector to the node B through a blocking diode D6 and having its emitter connected to ground. The transistor T4 further receives at its base the RST signal via the junction of a pair of divider resistors R8 and R10 connected between the signal line 31 and ground.

Figures 7A, 7B, 7C, 8:
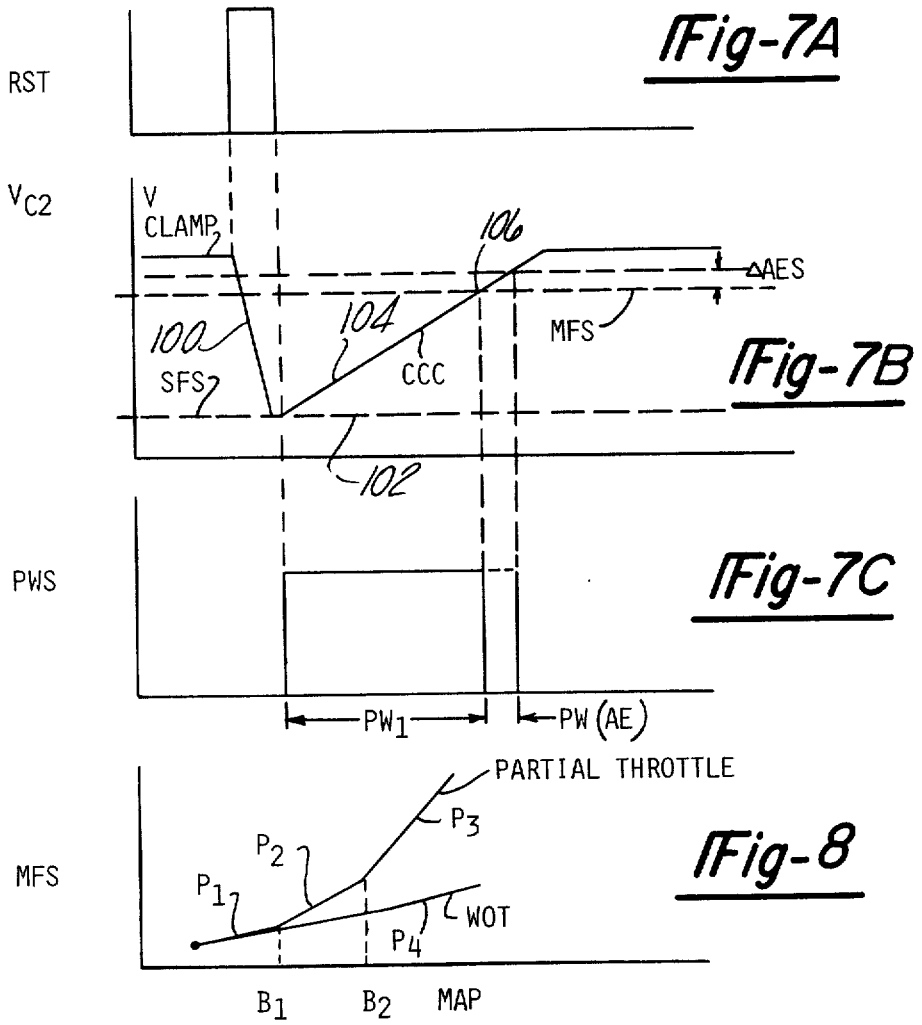

For the operation of the circuit of FIG. 4, attention is now directed to the waveform drawings, FIGS. 7A-7C, where it is seen that the RST signal is a pulse occurring at a rate dependent on the speed of revolution of the engine. One pulse width of signal PWS, seen in FIG. 7C, is generated for each RST signal and is synchronous to the trailing edge thereof. FIG. 7B illustrates the voltage on the timing capacitor C2 which, in combination with the amplifier A4, determines the duration of the pulse width signal PWS.

Initially, for a pulse generation the timing capacitor C2 has been charged to a voltage $V_{clamp}$ which is the junction voltage of the dividers R12 and R14. The capacitor is fully charged to $V_{clamp}$ by the continuous current provided to node A by the CCC signal, but will not charge further because of the forward biasing of the diode D2 when the voltage on capacitor exceeds $V_{clamp}$ by approximately 0.6 v. At some instant the pulse signal RST is applied to the base of transistor T2 thereby turning it on. Since the non-inverting input of the amplifier A2 is connected to the node A, which is at the clamp voltage and higher than the SFS signal, the output of amplifier A2 becomes conductive allowing the transistor T2 to start discharging the capacitor C2 through the amplifier output to ground. This discharge is shown on the waveform of FIG. 7B at 100.

Once the voltage level on the capacitor C2 has reached the SFS level 102 the amplifier A2 will shut off and no longer allow the capacitor C2 to discharge. At this point the voltage on the inverting input of the amplifier A4 is that of the capacitor C2, and at a level equivalent to the SFS signal.

During the entire time that the RST signal is present, transistor T4 is turned on via the resistor divider combination of R8 and R10, and through diode D6 grounds the output of amplifier A4 and pull-up resistor R4. The output of amplifier A4 would normally go high because of the low voltage, SFS, provided on its inverting input via the capacitor C2.

Once the RST signal is terminated, transistors T2, T4 become non-conductive. The capacitor C2 and, hence, the inverting input of amplifier A4, begins to charge according to the current supplied by the signal CCC. This voltage shown at 104 ramps toward the MFS level and begins the generation of the pulse $PW_1$. When the voltage on C2 exceeds the MFS signal at 106, the amplifier A4 will switch back to a conducting operation and the PWS signal will go low.

If the MFS signal is provided with an additional increment of voltage, ΔAES, then the pulse width will be extended a length PW(AE) and acceleration enrichment fuel will be provided to the engine during this time period. The additional increment of voltage is provided according to the invention by combining the acceleration enrichment signal AES and manifold pressure function signal MFS in such a manner that they do not interact detrimentally with each other.

Figure 5:
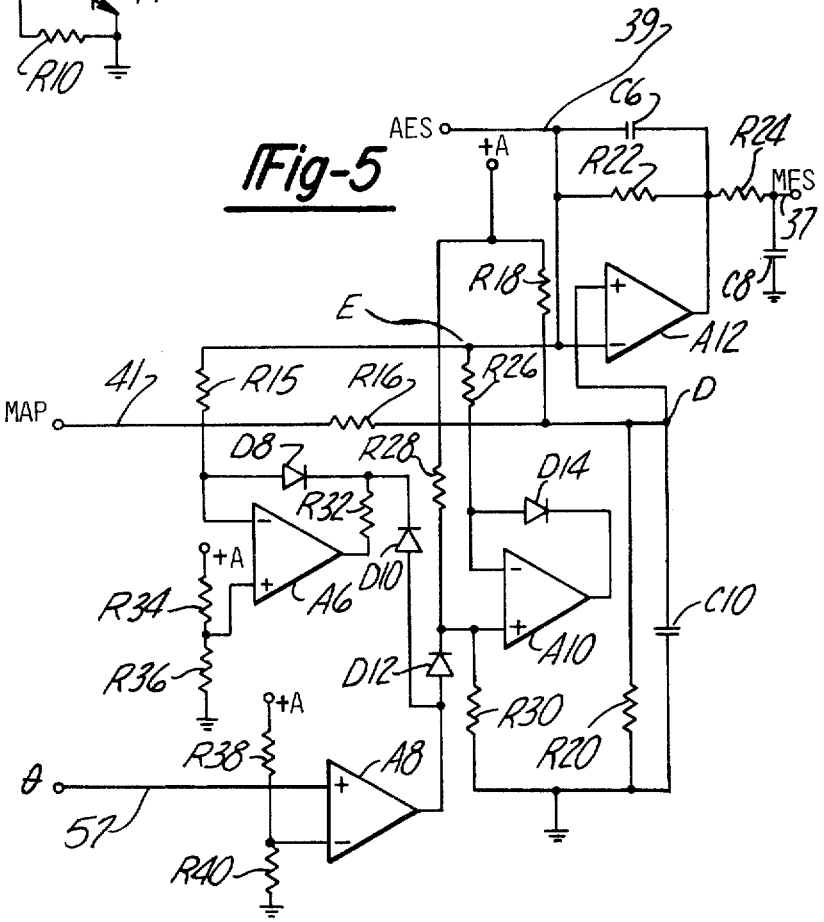
FIG. 5 is a detailed schematic circuit diagram of the pressure sensing circuit illustrated in FIG. 2.

The generation of the MFS signal and its relationship to and in combination with the AES signal will now be more fully explained with reference to FIG. 5 where there is shown a detailed circuit schematic of the pressure sensing circuit 36. The pressure sensing circuit 36 comprises a variable gain amplifier, operational amplifier A12, which has its non-inverting input connected to a node D which is the junction of a pair of resistor dividers R18 and R20 connected between a source of positive voltage, +A, and ground. The input to the junction at node D is a MAP signal via a resistor R16 from conductor 41. The MAP signal input to conductor 41 is generated by a transducing sensor (not shown) located in the intake manifold of the internal combustion engine 10, which provides a voltage representative of the changing pressure and conditions in the intake manifold. Resistors R16, R18, and R20 are provided as a variable trim for the differing characteristics of each MAP sensor found in production.

A high frequency filter capacitor C1 is connected between the node D and ground to provide filtering of this signal which thereafter is used as an indication of the absolute pressure in the manifold at the non-inverting input of the amplifier A12.

The variable gain amplifier A12 has a feedback resistor R22 and a filter capacitor C6 connected in parallel between its output and its inverting input. The amplifier A12 further has a low pass filter for the elimination of noise and transient voltages from the MFS signal comprising a resistor R24 connected between its output and one terminal of a capacitor C8 whose other terminal is connected to ground. The manifold function signal MFS is then transmitted to the pulse width generation circuit 32 from the junction of the resistor R24 and capacitor C8 via line 37.

A first break-point amplifier A10 acting as a comparator is provided for the pressure sensing circuit by connecting its inverting input to the inverting input of the amplifier A12 through a bias resistor R26. The amplifier A10 has a uni-directional conduction diode D14 with its anode connected to the inverting input and its cathode connected to the output. The amplifier A10 is further provided with a first break-point voltage at the junction of a pair of divider resistors R28 and R30 connected between the source of positive voltage, +A, and ground. The break-point voltage is applied to the non-inverting input of the amplifier A10 as a threshold voltage.

A similar second break-point circuit is provided by an amplifier A6 acting as a comparator which is connected at its inverting input to node E via resistor R15. A uni-directional conducting diode D8 in series with a resistor R32 connects the output of the amplifier A6 to its inverting input. The amplifier A6 is further provided with a second break-point voltage developed at the junction of a pair of divider resistors R34 and R36 connected between a source of positive voltage, +A, and ground. The second break-point voltage is applied to the non-inverting input of the amplifier A6.

An amplifier A8 produces a wide-open throttle correction to the MFS signal via the first and second break-point circuits of amplifiers A10 and A6. The amplifier A8 has its output connected to each break-point circuit via a diode D12 and a diode D10, respectively. The non-inverting input of the amplifier A10 is connected to the throttle angle signal $\theta$ thereby indicating the position of the throttle. The inverting input of the amplifier A8 is connected to a threshold voltage indicative of a wide-open throttle developed by a pair of divider resistors R38, R40 connected between a source of positive voltage, +A, and ground.

The operation of the circuit of FIG. 5 will now be explained in relationship to the waveform seen in FIG. 8 where the manifold function signal MFS is graphed as the ordinant of the independent variable manifold absolute pressure, or MAP.

In regions of low manifold absolute pressure, at partial throttle around idle and at low speeds, the engine is operating in the region P1 of the graph of FIG. 8. Amplifiers A10 and A6 are non-conducting since the break-point threshold voltage applied at the non-inverting input of each is higher than the voltages fed back to their inverting inputs. The gain of the amplifier A12 is essentially one, and it will act as a voltage buffer for MAP signals. The MFS signal will track the MAP signal which linearly increases with increasing manifold absolute pressure.

In the region of the graph P2, the feedback signal at the inverting input of A10 has exceeded the first break-point threshold B1 and the amplifier begins to conduct through diode D14 and, hence, resistor R26, raising the gain of amplifier A12. MAP signals in excess of the first break-point B1 provide an increase in fuel pulse width for these higher loads, as seen in the graph. This region is generally considered the normal driving area of the vehicle for partial throttle conditions.

In the next region P3, the MAP signal voltage feedback to node E and, hence, to the inverting input of amplifier A6, has exceeded the threshold developed by the second break-point threshold B2. Consequently, amplifier A6 will become conducting and raise the gain of amplifier A12 by forming a conducting path through resistors R15, R32, diode D8, and its output.

The conduction through diode D8 and resistor R32 lowers the effective parallel resistance seen at node E in relationship to the resistor R22 and thereby raises the gain of the amplifier A12. The increase in gain provides an increased slope to the MFS signal in region P3 to increase pulse width at conditions where power and high speed are present.

At wide-open throttle, generally the calibration for increased pulse width will be provided elsewhere in the circuit (such as by the CCC signal) and the amplifier A8 provides a high voltage blocking both amplifier A6 and A10 from providing increased gains and, hence, the slope of the MFS signal continues on the line P4 which is an extension of the MAP signal with the amplifier A12 having a gain of approximately one.

The AES signal is input to node E via line 39 to draw current away from the capacitor C6 and the input of the amplifier A12. The current drawn away from the inverting input of amplifier A12 causes an incrementally greater voltage output from the amplifier as it attempts to maintain a constant voltage between the two input terminals. The increased output is seen as a voltage change in the MFS signal which extends the pulse width. A change in the AES signal current will thus provide a proportional voltage change ΔAES that modifies the pulse width termination voltage to enrich the air/fuel ratio. Amplifier A12 is a high gain operational amplifier that can be utilized in such a manner without detrimentally affecting the MAP calibration according to one of the objects of the invention.

Figure 6:
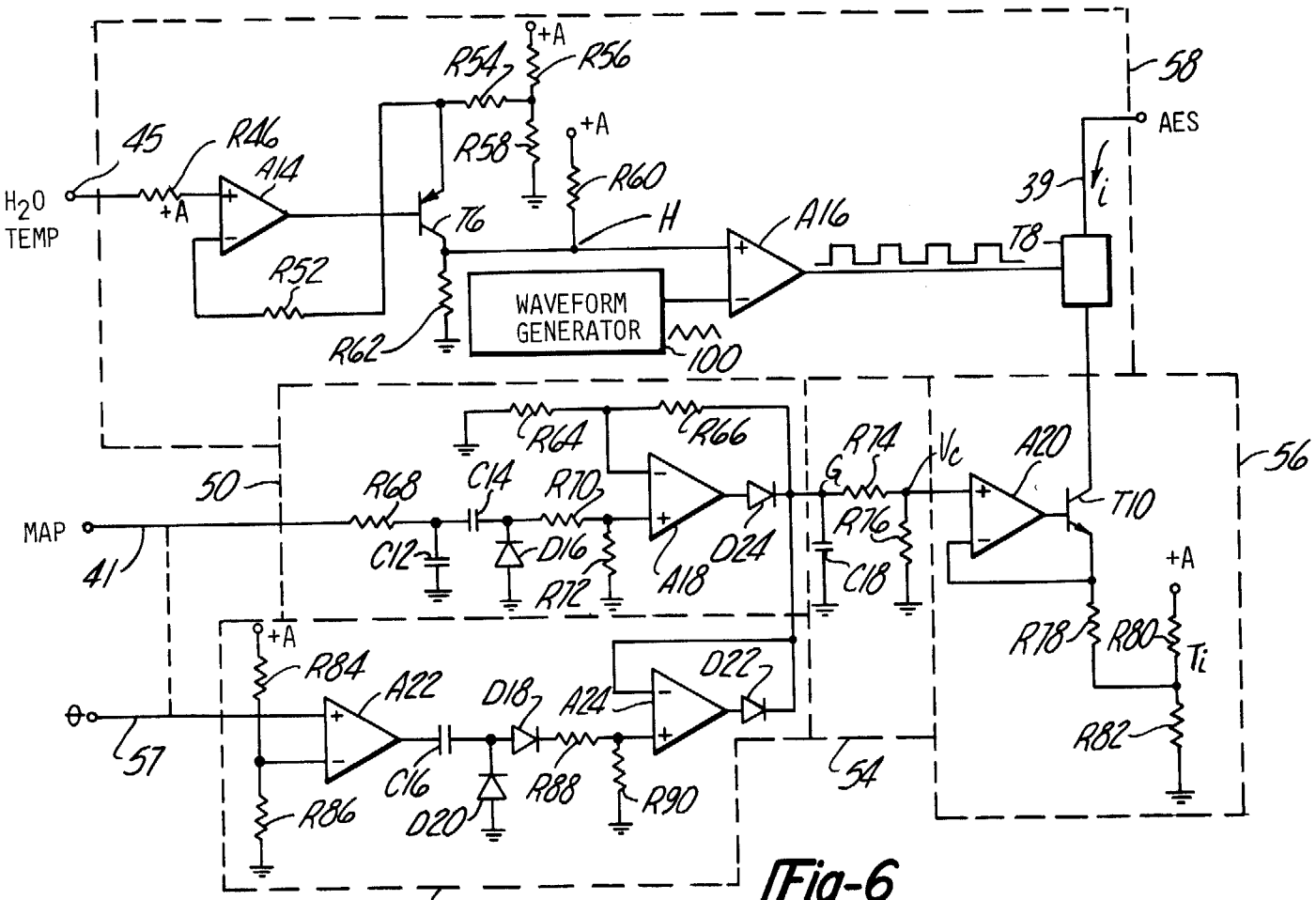
FIG. 6 is a detailed schematic circuit diagram of the acceleration enrichment circuit illustrated in FIGS. 2 and 3.

With reference now to FIG. 6, there is shown the detailed circuitry for the generation of the acceleration enrichment current signal AES. The voltage controlled current sink 56 is shown implemented as an operational amplifier A20 having its output connected to the base of an NPN transistor T10 which has its emitter coupled to the inverting input of the amplifier and its collector connected to the AES signal output line 39 through a controllable switching device T8. The emitter of the transistor T10 is further connected through a resistor R78 to the junction of a pair of divider resistors R80 and R82 connected between a source of positive voltage, +A, and ground. The value of resistor R78 regulates the slope of the current source or the increment the current signal will change for incremental changes in the control voltage signal. The divider R80, R82 provides a threshold which the control voltage must exceed before transistor T10 becomes conductive.

The control voltage $V_c$ for the voltage controlled current sink 56 is applied to the non-inverting input of the amplifier A20 from the peak detect and decay circuit 54, which comprises a capacitor C18 connected between a node G and ground and a pair of divider resistors R74 and R76 also connected between the node G and ground. The junction of the divider resistors is connected to the non-inverting input of the amplifier A20 to provide the control voltage signal.

Input to the node G is from two sources. One source is the operating parameter enrichment circuit 50 which comprises a first order differentiator having an amplifier A18 with its output connected to the node through a diode D24. The gain of the amplifier A18 is set by connecting the inverting input of the amplifier to the junction of a pair of feedback resistors R66 and R64 connected between the node G and ground. The input to the amplifier A18 is provided at its non-inverting input via the junction of a pair of divider resistors R70 and R72 connected between the cathode of a clipping diode D16 and ground. The anode of the diode D16 is also connected to ground. A series differentiator comprising a resistor R68 and a capacitor C14 is connected between the MAP input line 41 and the cathode of the diode D16. A high frequency filter capacitor C12 that shunts noise to ground is connected between the junction of the resistor R68 and the capacitor C14 and ground. Alternatively, as is indicated, the throttle position signal, $\theta$, can be input to the circuit 50.

The other input to the peak detect and decay circuit 54 is from the off-closed throttle enrichment circuit 52 comprising an amplifier A24 of unitary gain having its output connected to the node G through a diode D22 and having its inverting input further connected to the cathode of the diode D22. Input to the amplifier A24 is via a series differentiator comprising a capacitor C16, a diode D18, and a resistor R88 connected to the non-inverting input. The non-inverting input of the amplifier A24 is further connected to ground through a divider resistor R90. A clipping diode D20 is connected between the junction of the capacitor C16 and the diode D18.

The input to the differentiating terminal of capacitor C16 is the output of a thresholding comparitor comprising an amplifier A22. The non-inverting input of the amplifier A22 is provided by the throttle position signal $\theta$ via line 57. A threshold voltage for the amplifier A22 is provided at its non-inverting input from the junction of a pair of divider resistors R84 and R86 connected between a source of positive voltage, +A, and ground.

A controllable switching device T8 acts as a chopper to multiply the AES signal by a warm-up multiplication factor provided as a variable duty cycle square wave output from a multiplier amplifier A16 to the control input of the device T8. A waveform generator 100 provides a triangular waveform to the inverting input to the amplifier A16 which is compared to a voltage applied to its non-inverting input at node H. A minimum threshold voltage is supplied to node H via the junction of a pair of divider resistors R60 and R62 connected between a source of positive voltage, +A, and ground.

The minimum threshold voltage on the non-inverting input will provide a duty cycle output from the amplifier which can be varied according to an additional voltage applied at the junction to increase the current sinking capability of the circuit AES. The additional voltage is provided by a current source generating a variable current through resistor R62. The current source comprises a PNP transistor T6 connected at its collector to the node H and having its emitter connected through a slope resistor R54 to the junction of a pair of break-point resistors R56 and R58 connected between the source of positive voltage, +A, and ground.

The control of the current source transistor T6 is provided by the output of an operational amplifier A14 connected to the base of the transistor T6. The gain of the amplifier A14 is regulated by a negative feedback resistor R52 connected between the base of the transistor T6 and its inverting input. The driving voltage input to the non-inverting input of the amplifier A14 through resistor R46 is the engine coolant temperature signal $H_2O$ TEMP via line 45.

The operation of the acceleration enrichment circuit will now be more fully described with reference to the detailed schematic FIG. 6 and waveforms 9A-F. Assume for the moment switching device T8 is fully conductive. The voltage controlled current sink 56 will sink a controlled amount of current through the collector-to-emitter junction of the transistor T10 according to its conductance. The amplifier A20 will regulate the conductance of the transistor T10 to equalize the voltages at its inverting and non-inverting inputs and, therefore, will draw a controlled amount of current related to the control voltage $V_c$ applied to its non-inverting input.

Before this can happen, however, the control voltage $V_c$ must exceed the threshold voltage produced at the junction of the resistors R80 and R82. This threshold voltage Ti, therefore, is the minimum value of the control voltage that will produce an acceleration enrichment signal AES as seen in FIG. 9A. Preferably, as is seen in the schedule, the current i drawn by the circuit after the threshold is exceeded will linearly increase with the control voltage $V_c$ at a rate (slope) determined by resistor R78.

The control voltage $V_c$ is developed representatively as the peak voltage $V_G$ detected on the capacitor C18, which has a discharge path through resistors R74 and R76 to provide for an exponential decay of the control signal voltage. Input to the peak detecting capacitor C18 is from the circuit 50 which takes the first derivative of either the MAP signal or the throttle position signal $\theta$.

The differentiated value from the serial differentiator C14, R68 is amplified and applied through the diode D24 to the capacitor C18. The gain of the amplifier A18, which acts as a buffer, will determine the amount of acceleration enrichment for a relative value of operating parameter.

The off-closed throttle pulse circuit receives the throttle position signal $\theta$ and compares it to the threshold developed at the junction of the resistors R84 and R86. If the throttle angle signal $\theta$ is greater than the threshold, which is set to indicate a throttle position slightly off the closed throttle position, a positive-going edge will be generated from the amplifier A22. The edge is differentiated by capacitor C16 and resistor R88 to form a pulse OCP as is illustrated in FIG. 9E. This pulse will be buffered by the amplifier A24 and applied to the capacitor C18 to provide additional enrichment to the engine by increasing the control voltage signal.

FIG. 9C illustrates waveform 114 as the angular movement of the throttle blade during an acceleration from a closed position, such as idle, to a relatively open position. The threshold for the off-closed throttle enrichment is exceeded at point 115 and causes the generation of OCP pulse 122. As the throttle continues to open, the first derivative of the signal $\theta$ will peak at the maximum rate of deflection of the throttle as seen by waveform 118. Waveforms 116 and 120 illustrate similar signals, if MAP is used to detect acceleration, which are offset by a small delay from the throttle angle signal.

The peak detect and decay circuit voltage at node G, $V_G$, as seen in FIG. 9F, will thus detect both of the peaks of the circuits 50, 52 at P5 and P6 to control the current according to the schedule previously described with reference to FIG. 9A. It is seen, because of the time relation of the OCP pulse with respect to the output of pulse 118, illustrated in FIG. 9D, additional enrichment is added. The voltage at node G, thereafter decays with a time constant $\tau 1$ fixed by the value of capacitor C18 and resistors R74, R76 to smooth out engine performance.

The multiplication of the acceleration enrichment signal by the warm-up factor will now be more fully explained. The acceleration enrichment signal AES, a controlled amount of current drawn from the pressure sensing circuit, is effectively chopped by the switching device T8, which performs the multiplication. The waveform generator 100 operates in conjunction with the voltage at the non-inverting input of the amplifier A16 to change the duty cycle of the driven switching device to multiply the current by the warm-up factor according to the schedule illustrated in FIG. 9B.

The voltage produced at the junction of the resistors R60 and R62 will provide a base duty cycle to provide a unity multiplier seen at 112 in FIG. 9B which can be increased by raising the voltage at node H to where a maximum enrichment factor at point 110 is reached. The voltage is raised at the node H by controllably varying the impedance of the current source transistor T6 with the output of the amplifier A14. The output voltage of the amplifier A14 is regulated by receiving the signal $H_2O$ TEMP, which indicates the temperature of the engine coolant at its non-inverting input.

Initially, at point 110 for acceleration enrichments at cold engine temperatures, the transistor T6 is fully conductive and a maximum "on" time for switching device T8 is obtained. As the engine coolant temperature increases, the output voltage of the operational amplifier A14 will increase and cause the transistor T6 to source less current to the resistor R62. The slope of this change is governed by resistor R54. The output voltage of the amplifier A14 increases to where it equals the breakpoint voltage at the junction of resistor R56, R58 and thus shuts the transistor T6 off. This condition, point 112 in FIG. 9B, indicates that the engine is completely warmed up and indicates, preferably, a coolant temperature of approximately 120° F. The duty cycle of the switch T8 will be a minimum and representative of a warm-up multiplication factor of unity.

While the preferred embodiments of the invention have been shown, it will be obvious to those skilled in the art that modifications and changes may be made to the disclosed system without departing from the spirit and scope of the invention as defined by the appended claims.

What is claimed is:

1. An electronic fuel management system having an acceleration enrichment feature producing an enriched air/fuel ratio to an internal combustion engine during operator induced transients, said system comprising:

a pulse width generation means for calculating the duration of pulses of a pulse width signal, said duration being indicative of the quantity of fuel metered into said internal combustion engine;

said pulse width generation means initiating each individual pulse at a rate dependent upon the RPM of the engine and timing the duration of each pulse with a controllable ramp voltage begun concurrently therewith, said ramp voltage beginning from a voltage level which is a function of an engine operating parameter and terminating at its intersection with a threshold voltage to end the pulse width;

a pressure sensing circuit, electrically connected to said pulse width generation means and responsive to the absolute pressure of the intake manifold, for generating said threshold voltage as a function of the absolute pressure of the intake manifold of the engine;

acceleration enrichment means for generating an acceleration enrichment signal that increases said threshold voltage to said pulse width generation means during operator induced transients, said acceleration enrichment means including a voltage controlled current sink means electrically connected to said pressure sensing circuit for varying said threshold voltage, said current sink means being regulated by a control voltage which is a function of said operator induced transient.

2. An electronic fuel management system as defined in claim 1 wherein said acceleration enrichment means further includes:

engine operating parameter sensing means for sensing the rate of change of an engine operating parameter indicative of a desired acceleration and generating an acceleration signal representative of the magnitude of said rate of change;

said acceleration signal controlling said voltage controlled current sink.

3. An electronic fuel management system as defined in claim 2 wherein said acceleration enrichment means further includes:

off-closed throttle enrichment means for providing an increased enrichment signal when the throttle of said internal combustion engine initially opens from a closed position.

4. An electronic fuel management system as defined in claim 3 wherein said acceleration enrichment means further includes:

peak detect means for detecting the peak of said acceleration signal and increased enrichment signal; said peak detector means generating said control voltage to said voltage controlled current sink based upon said peak and thereafter allowing said control voltage to decay at a controlled rate.

5. An electronic fuel injection system as defined in claim 2 wherein said acceleration enrichment means further includes:

warm up means for varying said acceleration enrichment signal dependently upon the operating temperature of said internal combustion engine.

6. An electronic fuel injection system as defined in claim 2 wherein:

said engine parameter indicative of acceleration is the absolute pressure of the intake manifold of the internal combustion engine.

7. An electronic fuel injection system as defined in claim 2 wherein:

said engine parameter indicative of acceleration is the angle of the throttle of the internal combustion engine.

8. An acceleration enrichment feature for a fuel management system of an internal combustion engine which generates pulses having a duration dependent upon a threshold voltage, said acceleration enrichment feature comprising:

peak detector means for generating an acceleration signal at the peak value of the rate of change of an engine operating parameter indicative of acceleration and thereafter allowing said acceleration signal to decay at a predetermined rate;

throttle enrichment means for providing an increased acceleration signal when the throttle of the internal combustion engine initially opens from a closed position;

enrichment means responsive to said acceleration signal and said increased acceleration signal for generating an acceleration enrichment signal and for varying the threshold voltage to enrich the air/fuel ratio of the internal combustion engine; and warm up means for varying said acceleration enrichment signal dependently upon the operating temperature of the internal combustion engine.

9. An acceleration enrichment feature as defined in claim 8 wherein said enrichment means include:

a voltage controlled current sink wherein said acceleration signal is the control voltage of said sink and the amount of current controlled therethrough is said acceleration enrichment signal.

10. An acceleration enrichment feature as defined in claim 8 wherein said warm up means comprises:

switch means connected in series with said current sink means for varying the amount of current through said sink by modulating the duty cycle ratio of the conducting time to the nonconducting time of said switch means.

11. An acceleration enrichment feature as defined in claim 8 wherein said peak detector means includes:

a capacitor means which is charged to the peak value of the rate of change of said engine operating parameter; and a resistive discharge path for allowing said peak value to decay exponentially according to a predetermined time constant.

12. An acceleration enrichment feature as defined in claim 11 wherein said feature further includes:

a differentiator means for generating said rate of change signal by differentiating an engine operating parameter related to acceleration.

13. An acceleration enrichment feature as defined in claim 11 wherein said throttle enrichment means includes:

an operational amplifier for charging said capacitor means to a predetermined voltage in response to the throttle leaving a closed position; said amplifier having its output connected to said capacitor means for charging the same, its inverting input connected to said capacitor means for feeding back the predetermined voltage, and its noninverting input connected to a reference pulse of a predetermined magnitude, said amplifier charging said capacitor until the voltage on the capacitor exceeds the magnitude of the reference pulse.

* * * * *